US011073263B2

(12) United States Patent
Zhou et al.

(10) Patent No.: US 11,073,263 B2
(45) Date of Patent: Jul. 27, 2021

(54) INSTALLATION ASSEMBLY FOR LIGHTING FIXTURE, LIGHTING SYSTEM AND METHOD FOR RETROFITTING TROFFER LIGHT

(71) Applicant: CURRENT LIGHTING SOLUTIONS, LLC, East Cleveland, OH (US)

(72) Inventors: Shouyong Zhou, Shanghai (CN); Honglei Gao, Shanghai (CN); Cuijuan Zhou, Shanghai (CN)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 231 days.

(21) Appl. No.: 16/419,502

(22) Filed: May 22, 2019

(65) Prior Publication Data

US 2019/0360670 A1 Nov. 28, 2019

(30) Foreign Application Priority Data

May 25, 2018 (CN) ..... 201810516661.8

(51) Int. Cl.
*F21V 21/04* (2006.01)
*F21S 8/02* (2006.01)

(52) U.S. Cl.
CPC ..... *F21V 21/049* (2013.01); *F21S 8/026* (2013.01); *F21V 21/041* (2013.01);
(Continued)

(58) Field of Classification Search
CPC .... F21V 21/049; F21V 21/048; F21V 21/045; F21V 21/044; F21V 21/041; F21S 8/026
(Continued)

(56) References Cited

U.S. PATENT DOCUMENTS 4,290,218 A * 9/1981 Drueck, Jr. ..... G09F 13/04 40/553
8,485,700 B2 * 7/2013 Ngai ..... E04B 9/00 362/404

(Continued)

FOREIGN PATENT DOCUMENTS

CN 107524990 A 12/2017

OTHER PUBLICATIONS

English Translation of CN107524990A. (Year: 2017).*

(Continued)

*Primary Examiner* — Laura K Tso
(74) *Attorney, Agent, or Firm* — Buckley, Maschoff & Talwalkar LLC

(57) ABSTRACT

An installation assembly for a lighting fixture comprises first and second loading bars. The first loading bar is slidably connected to a first side of the lighting fixture and configured to slide in a direction perpendicular to a longitudinal direction of the first loading bar. The first loading bar comprises a first projecting portion. The second loading bar is connected to a second side of the lighting fixture opposite to the first side and comprises a second projecting portion. The troffer has first and second recessed portions respectively on two opposite inner side walls thereof. The first loading bar is configured to slide to a first position to allow the first and second projecting portions to pass through an opening of the troffer, and configured to slide to a second position, to enable the first and second projecting portions to respectively fit into the first and second recessed portions.

13 Claims, 5 Drawing Sheets

(52) U.S. Cl.
CPC ..... *F21V 21/044* (2013.01); *F21V 21/045* (2013.01); *F21V 21/048* (2013.01)

(58) Field of Classification Search
USPC ..... 362/365, 364, 148, 150, 404
See application file for complete search history.

(56) References Cited

U.S. PATENT DOCUMENTS

| | | | | |
|---|---|---|---|---|
| 10,539,273 | B1 * | 1/2020 | Cai | F21K 9/68 |
| 2016/0138789 | A1 * | 5/2016 | Brown | F21V 23/0442 362/95 |
| 2018/0363888 | A1 * | 12/2018 | James | F21V 21/048 |

OTHER PUBLICATIONS

Chinese Office Action dated Mar. 15, 2021 which was issued in a counterpart application CN201810516661.8 which was filed on May 25, 2018.

* cited by examiner

INSTALLATION ASSEMBLY FOR LIGHTING FIXTURE, LIGHTING SYSTEM AND METHOD FOR RETROFITTING TROFFER LIGHT

BACKGROUND

Embodiments of the present disclosure relate generally to installation assemblies for lighting fixtures, lighting systems and methods for retrofitting troffer lights.

In recent years, luminaires retrofit market is growing significantly. Retrofit LED luminaires can be used to replace the original fluorescent lamps to increase luminous efficiency and improve luminous effect.

The recessed troffer light is a conventional luminaire that is mounted in the ceiling and is generally constructed of a luminous tube, a housing, a reflector cup, and some fasteners. Since it is embedded in the ceiling and its structure is complicated, the steps of retrofitting it are complicated and require a large labor cost. Therefore, how to simplify the retrofit step of the troffer light and improve the retrofit efficiency is becoming an urgent problem to be solved.

Therefore, it is desirable to provide new installation assemblies for lighting fixtures, lighting systems and methods for retrofitting troffer lights to solve the above-mentioned problem.

BRIEF DESCRIPTION

In one aspect, embodiments of the present disclosure relate to an installation assembly for a lighting fixture, wherein the installation assembly is connected with the lighting fixture and configured to contract in at least one direction to be at least partly embedded in a troffer. The installation assembly comprises a first loading bar and a second loading bar. The first loading bar is slidably connected to a first side of the lighting fixture and configured to slide in a direction substantially perpendicular to a longitudinal direction of the first loading bar. The first loading bar comprises a first projecting portion. The second loading bar is connected to a second side of the lighting fixture opposite to the first side and comprises a second projecting portion. The troffer has a first recessed portion and a second recessed portion respectively on two opposite inner side walls of the troffer. The first loading bar is configured to slide to a first position, to allow the first projecting portion and the second projecting portion to pass through an opening of the troffer into the troffer. The first loading bar is configured to slide to a second position, to enable the first projecting portion to fit into the first recessed portion and the second projecting portion to fit into the second recessed portion.

In another aspect, embodiments of the present disclosure relate to a lighting system. The lighting system comprises a lighting fixture and an installation assembly connected with the lighting fixture and configured to contract in at least one direction to be at least partly embedded in a troffer. The installation assembly comprises a first loading bar and a second loading bar. The first loading bar is slidably connected to a first side of the lighting fixture and configured to slide in a direction substantially perpendicular to a longitudinal direction of the first loading bar. The first loading bar comprises a first projecting portion. The second loading bar is connected to a second side of the lighting fixture opposite to the first side and comprises a second projecting portion. The troffer has a first recessed portion and a second recessed portion respectively on two opposite inner side walls of the troffer. The first loading bar is configured to slide to a first position, to allow the first projecting portion and the second projecting portion to pass through an opening of the troffer into the troffer. The first loading bar is configured to slide to a second position, to enable the first projecting portion to fit into the first recessed portion and the second projecting portion to fit into the second recessed portion.

In yet another aspect, embodiments of the present disclosure relate to a method for retrofitting a troffer light by a lighting system, wherein the troffer light is recessed into a ceiling system comprising T-grids, the troffer light comprises a luminaire and a housing above the T-grids. The lighting system comprises a lighting fixture, a first loading bar slidably connected to a first side of the lighting fixture and a second loading bar connected to a second side of the lighting fixture opposite to the first side. The method comprises removing the luminaire; sliding the first loading bar to a first position in a direction substantially perpendicular to a longitudinal direction of the first loading bar; inserting a first projecting portion of the first loading bar into a first gap between a lower edge of a first side wall of the housing and a first T-grid of the T-grids; aligning a second projecting portion of the second loading bar with a second gap between a lower edge of a second side wall of the housing and a second T-grid of the T-grids; and sliding the first loading bar to a second position, to enable the second projecting portion fit into the second gap.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

In an effort to provide a concise description of these embodiments, not all features of an actual implementation are described in one or more specific embodiments. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort would nevertheless be a routine undertaking of design, fabrication, and manufacture for those of ordinary skill having the benefit of the present disclosure.

Unless defined otherwise, technical and scientific terms used herein have the same meaning as is commonly understood by one of ordinary skill in the art to which the present disclosure belongs. The terms "first," "second," "third," "fourth," and the like, as used herein do not denote any order, quantity, or importance, but rather are used to distinguish one element from another. Also, the terms "a" and "an" do not denote a limitation of quantity, but rather denote the presence of at least one of the referenced items. The term "or" is meant to be inclusive and mean either any, several, or all of the listed items. The use of "including," "comprising," or "having," and variations thereof herein are meant to encompass the items listed thereafter and equivalents thereof as well as additional items.

Embodiments of the present disclosure relate to an installation assembly for a lighting fixture, and a lighting system comprising the installation assembly.

Figure 1:
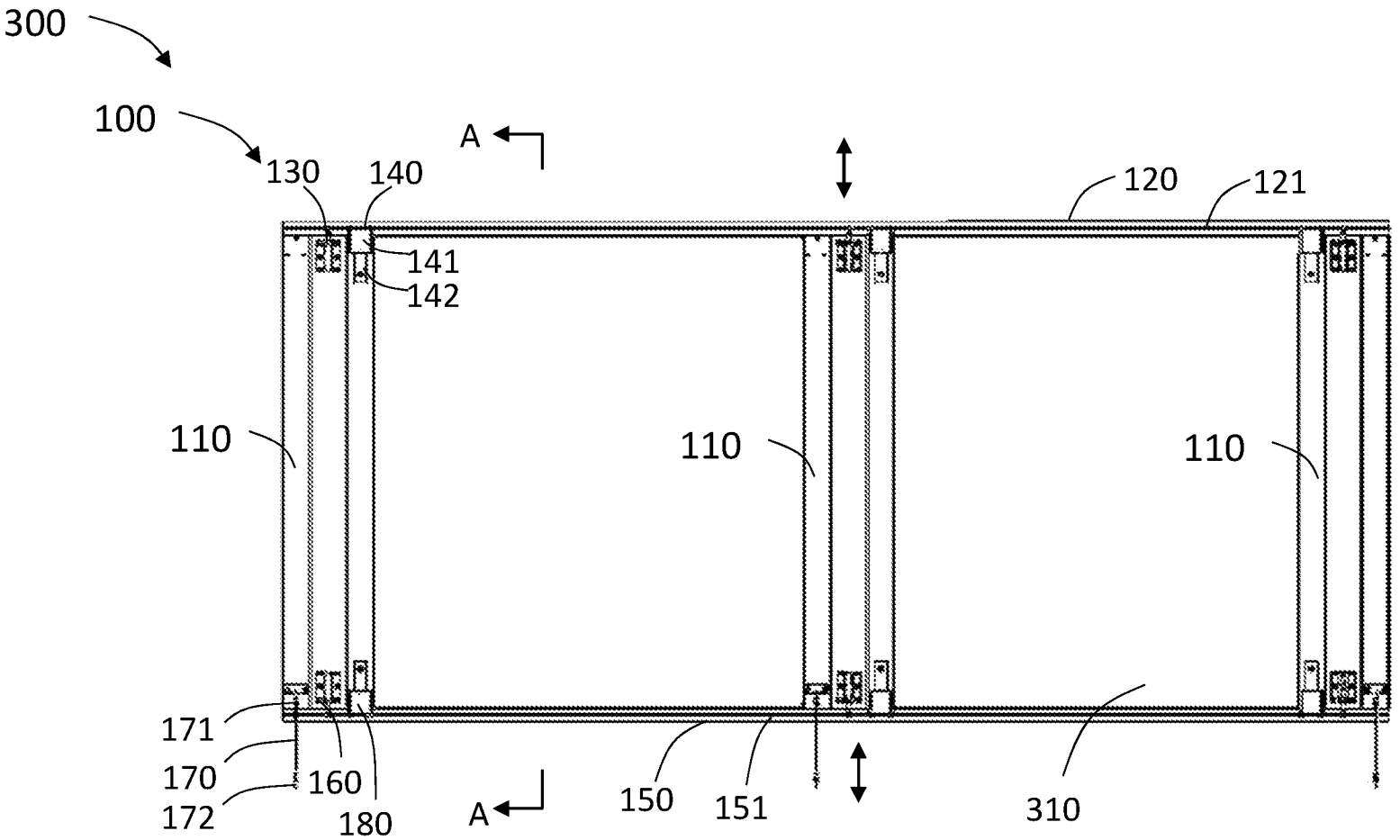
FIG. 1 is a top view of a lighting system in accordance with an exemplary embodiment of the present disclosure.
Figure 2:
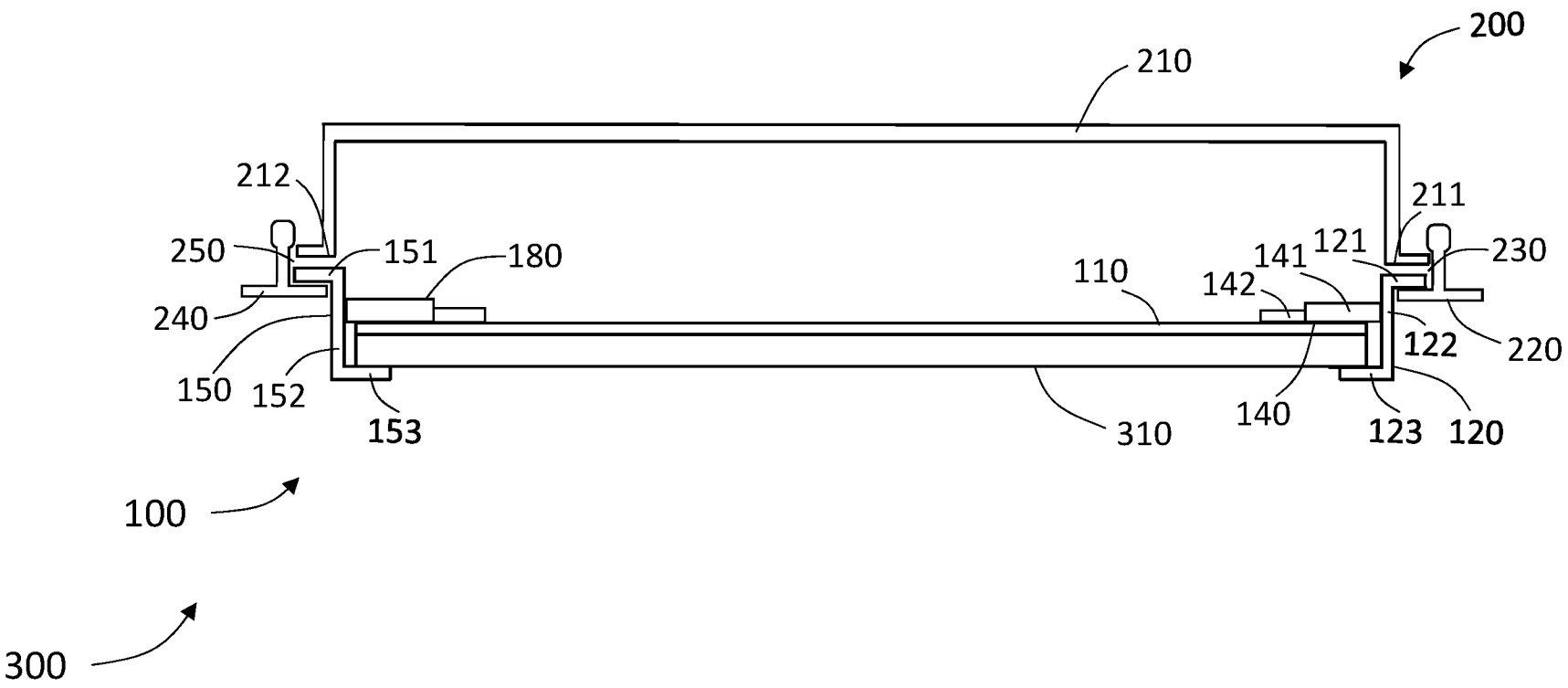
FIG. 2 is a sectional-view of the lighting system in FIG. 1 taken along line A-A.

FIG. 1 and FIG. 2 show a lighting system 300 in accordance with an exemplary embodiment of the present disclosure, wherein FIG. 1 is a top view of the lighting system 300, and FIG. 2 is a sectional-view of the lighting system 300 in FIG. 1 taken along line A-A.

Referring to FIG. 1 and FIG. 2, the lighting system 300 comprises a lighting fixture 310 and an installation assembly 100 connected with the lighting fixture 310. The lighting fixture 310 may comprise a panel light, a troffer light or a combination thereof.

The installation assembly 100 is configured to contract in at least one direction to be at least partly embedded in a troffer 200, in such a manner that the lighting fixture 310 can be fixed in the troffer 200 via the installation assembly 100. The troffer 200 is defined by four side walls and a top wall, wherein the four side walls surround the top wall. The troffer 200 has a first recessed portion 230 and a second recessed portion 250 respectively on inner walls of the two opposite side walls (i.e.: inner side wall).

The installation assembly 100 comprises a first loading bar 120 and a second loading bar 150. The first loading bar 120 is slidably connected to a first side of the lighting fixture 310 and configured to slide in a direction substantially perpendicular to a longitudinal direction of the first loading bar. The second loading bar 150 is connected to a second side of the lighting fixture 310 opposite to the first side. The first loading bar 120 comprises a first projecting portion 121, and the second loading bar 150 comprises a second projecting portion 151.

The first loading bar 120 is configured to slide between a first position and a second position along the direction substantially perpendicular to the longitudinal direction thereof, and the first loading bar 120 is closer to a central portion of the lighting fixture 310 at the first position than at the second position. The first loading bar 120 is configured to slide to the first position to allow the first projecting portion 121 of the first loading bar 120 and the second projecting portion 151 of the second loading bar 150 to pass through an opening of the troffer into the troffer 200, and the first loading bar 120 is also configured to slide to the second position to enable the first projecting portion 121 to fit into the first recessed portion 230 and the second projecting portion 151 to fit into the second recessed portion 250; in such a manner that the installation assembly 100 can be supported by the side walls of the troffer 200 and thus be fixed in the troffer 200. The installation assembly 100 has an elastic structure, which greatly reduces the requirements for installation environment. The only requirement for the installation environment is that the inner walls of the troffer have recessed portions for the loading bar to fit in. Therefore, labor costs for retrofitting the installation environment can be saved, and installation steps can be greatly simplified.

In the embodiment shown in FIG. 2, the troffer 200 is defined by a housing 210 of a troffer light and T-grids 220, 240 of a ceiling system, wherein the housing 210 is located above the T-grids and there is a gap between the housing 210 and the T-grids. The housing 210 comprises a top wall and four side walls surrounding the top wall, i.e.: a first, second, third and fourth side wall. The first recessed portion 230 is defined by a space between a lower edge 211 of the first side wall of the housing 210 and a first T-grid 220 of the T-grids, and the first recessed portion 230 is a strip-shaped groove. Similarly, the second recessed portion 250 is defined by a space between a lower edge 212 of the second side wall of the housing 210 and a second T-grid 240 of the T-grids, and the second recessed portion 250 is a strip-shaped groove.

In the embodiment shown in FIG. 1 and FIG. 2, the first projecting portion of the first loading bar 120 comprises a first projecting trim 121 which is strip-shaped and extends along the longitudinal direction of the first loading bar. The first projecting trim 121 has a shape and a size matching the first recessed portion 230 (i.e.: the groove). When the installation assembly needs to be fixed, the first projecting trim 121 is configured to be inserted into the first recessed portion 230.

In some embodiments, the first loading bar 120 further comprises a first side trim 122 and a first bottom trim 123, which are strip-shaped and extend along the longitudinal direction of the first loading bar. The first side trim 122 is connected between the first projecting trim 121 and the first bottom trim 123. The first side trim 122 has a first side connected with the first projecting trim 121, and the first side trim 122 and the first projecting trim 121 form a first included angle, which is, for example, in a range from about 60 degrees to about 120 degrees, or about 90 degrees. The first side trim 122 has a second side connected with the first bottom trim 123, and the first side trim 122 and the first bottom trim 123 form a second included angle, which is, for example, in a range from about 60 degrees to about 120 degrees, or about 90 degrees. The first projecting trim 121 extends from the first side of the first side trim 122 in a direction away from the lighting fixture 310, and the first bottom trim 123 extends from the second side of the first side trim 122 in a direction close to the lighting fixture 310. In some embodiments, the first projecting trim 121 and the first bottom trim 123 are substantially parallel. In some embodiments, the first loading bar 120 as a whole is a stick having a cross section substantially in a shape of "Z" or "H".

Similarly, the second projecting portion of the second loading bar 150 comprises a second projecting trim 151 which is strip-shaped and extends along the longitudinal direction of the second loading bar. The second projecting trim 151 has a shape and a size matching the second recessed portion 250 (i.e.: the groove). When the installation assembly needs to be fixed, the second projecting trim 151 is configured to be inserted into the second recessed portion 250. In some embodiments, the second loading bar 150 further comprises a second side trim 152 and a second bottom trim 153, which are strip-shaped and extend along the longitudinal direction of the second loading bar. Structures of the second projecting trim 151, the second side trim 152 and the second bottom trim 153 and connections among them are similar to those of the first projecting trim 121, the second side trim 122 and the second bottom trim 123 of the first loading bar 120, which will not be repeated here.

In the embodiment shown in FIG. 2, the first side trim 122 extends from the first projecting trim 121 to the first bottom trim 123 in a direction away from the troffer 200, and the second side trim 152 extends from the second projecting trim 151 to the second bottom trim 153 in a direction away from the troffer 200. The lighting fixture 310 is located on the first bottom trim 123 and the second bottom trim 153, i.e.: when the lighting fixture is installed in the troffer 200, the first and second bottom trim 123, 153 are configured to support the lighting fixture 310. Therefore, at least a part of the lighting fixture 310 is not received by the troffer 200, and the at least a part of the lighting fixture 310 protrudes from the troffer 200 and the ceiling system.

As shown in FIG. 1, the installation assembly 100 further comprises a first elastic device 130, which is provided between the first loading bar 120 and the lighting fixture 310 and configured to move the first loading bar from the first position to the second position by an elastic force. When the first loading bar 120 is at the first position, the second elastic device 130 has a first deformation. When the first loading bar 120 is at the second position, the first elastic device 130 has a second deformation less than the first deformation, or the first elastic device 130 does not deform. Therefore, the first elastic device 130 is able to move the first loading bar 120 from the first position to the second position by releasing elastic potential energy without applying an external force. Specifically, the first elastic device 130 comprises a first end and a second end which are telescopically movable relative to each other, wherein the first end is fixed to the lighting fixture and the second end is fixed to the first loading bar, such that the first loading bar is slidable relative to the lighting fixture. The first loading bar can be moved from the first position to the second position by the elastic force without applying an external force. In some embodiments, the second end of the first elastic device is secured to the first side trim of the first loading bar.

In some embodiments, the installation assembly further comprises a first sliding unit 140 provided between the first loading bar 120 and the lighting fixture 310. The first loading bar 120 is slidably connected to the lighting fixture 310 via the first sliding unit 140. The first sliding unit 140 is configured to lead the first loading bar 120 to slide along a path between the first position and the second position. In some embodiments, the first sliding unit 140 comprises a sliding rail and a slider, wherein the sliding rail is fixed on one of the first loading bar and the lighting fixture, and the slider is fixed on the other one of the first loading bar and the lighting fixture. The slider is able to slide along the sliding rail such that the first loading bar can slide relative to the lighting fixture in a direction of the sliding rail. In some embodiments, the first elastic device and the first sliding unit can be integrated into a single unit, such as a sliding device with elastic members.

In the embodiment shown in FIG. 1 and FIG. 2, the installation assembly further comprises a bearing bar 110 fixed to a non-luminous surface of the lighting fixture 310. The lighting fixture 310 is connected to the elastic device and the sliding unit via the bearing bar 110. The bearing bar 110 can be arranged in a direction generally perpendicular to the first loading bar.

The first elastic device 130 and the first sliding unit 140 are installed between the first loading bar 120 and the bearing bar 110. Specifically, the first end of the first elastic device 130 is fixed on the bearing bar 110, and the second end of the first elastic device 130 is fixed on the first loading bar 120, for example, on the first side trim 122 of the first loading bar 120. The first sliding unit 140 comprises a sliding rail 141 and a slider 142. The slider 142 is fixed to the bearing bar 110 and the sliding rail 141 is fixed to the first loading bar 120. More specifically, one end of the sliding rail 141 is fixed to the first side trim 122 of the first loading bar 120, and the sliding rail is generally perpendicular to the first side trim 122.

In some embodiments, to accommodate the actual size of the lighting fixture, the installation assembly 100 may comprise multiple sets of the elastic device, the sliding unit, and the bearing bar, to increase stability of installation. In the embodiment shown in FIG. 1, the installation assembly 100 comprises three sets of the elastic device 130, the sliding unit 140, and the bearing bar 110, which are evenly distributed over the non-luminous surface of the lighting fixture 310.

Continuing referring to FIG. 1 and FIG. 2, the second loading bar 150 is slidably connected to the second side of the lighting fixture and configured to slide in a direction substantially perpendicular to a longitudinal direction of the second loading bar. The second loading bar 150 is configured to slide to a third position to allow the first projecting portion 121 and the second projecting portion 151 to pass through the opening of the troffer into the troffer, and the second loading bar 150 is also configured to slide to a fourth position to enable the first projecting portion 121 to fit into the first recessed portion 230 and the second projecting portion 151 to fit into the second recessed portion 250. The third position is closer to the central portion of the lighting fixture than the fourth position.

Accordingly, the installation assembly 100 further comprises a second elastic device 160 and a second sliding unit 180. The second elastic device 160 is provided between the second loading bar 150 and the bearing bar 110 of the lighting fixture, and configured to move the second loading bar from the third position to the fourth position by an elastic force. When the second loading bar 150 is at the third position, the second elastic device 160 has a third deformation. When the second loading bar 150 is at the fourth position, the second elastic device 160 has a fourth deformation less than the third deformation, or the second elastic device 160 does not deform. The second sliding unit 180 is provided between the second loading bar 150 and the bearing bar 110 of the lighting fixture, and configured to lead the second loading bar 150 to slide along a path between the third position and the fourth position. Structures of the second elastic device 160 and the second sliding unit 180, and their connections to the second loading bar and the bearing bar are similar to those of the first elastic device 160 and the second sliding unit 180 and their connections to the first loading bar and the bearing bar, which will not be repeated here.

Referring to FIG. 1 again, the installation assembly 100 further comprises a safety tether 170 having a first end 171 and a second end 172. The first end 171 is connected to the lighting fixture 310 or other elements of the installation assembly 100, and the second end 172 is configured to be connected to the troffer 200 when installing the lighting fixture, in order to prevent the lighting fixture 300 from falling down when being installed. In the embodiment shown in FIG. 1, the first end 171 of the safety tether 170 is fixed to the bearing bar 110 of the lighting fixture 310, such that the safety tether 170 is connected to the lighting fixture 310 via the bearing bar 110.

Figure 3:
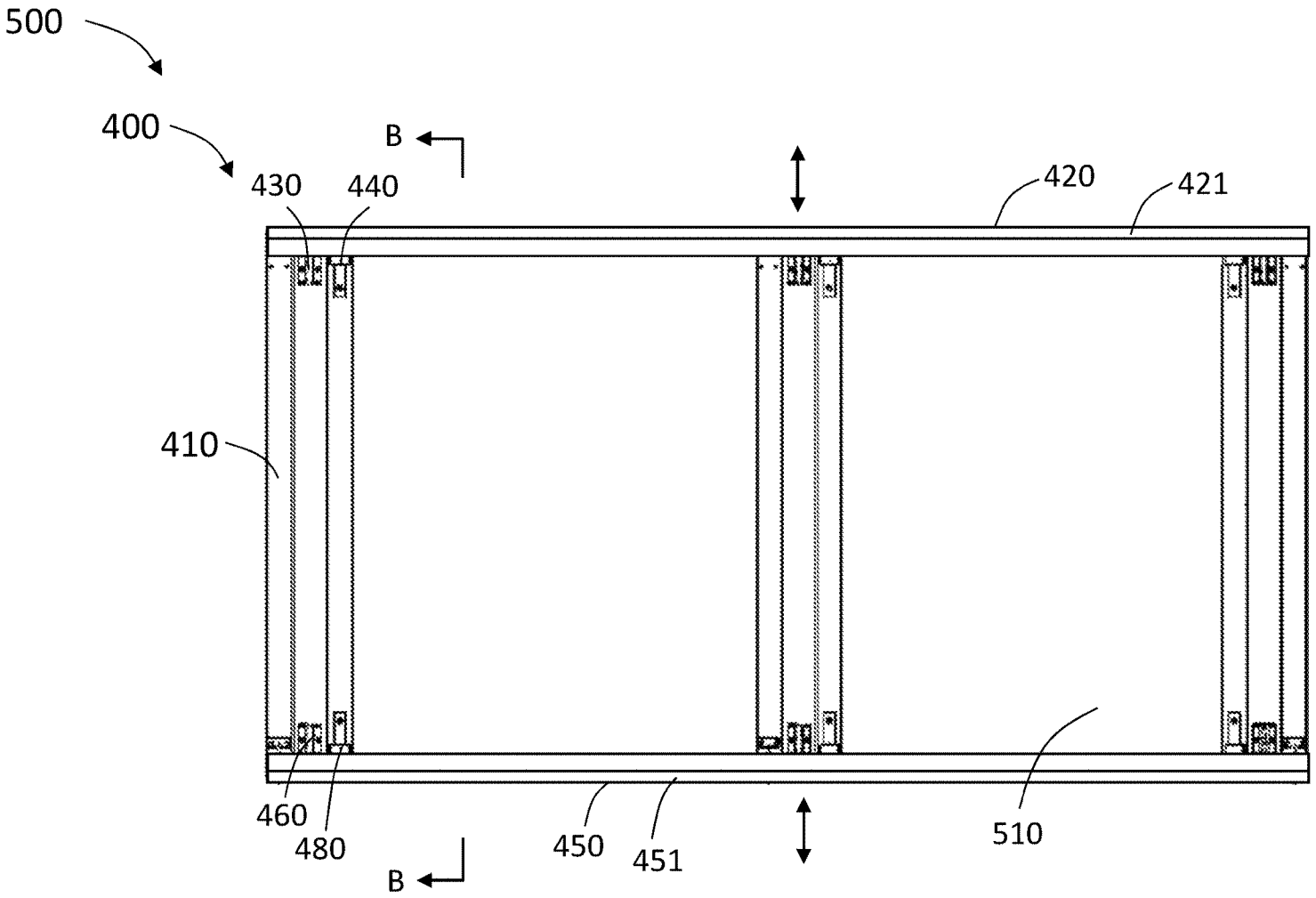
FIG. 3 is a top view of a lighting system in accordance with another exemplary embodiment of the present disclosure.
Figure 4:
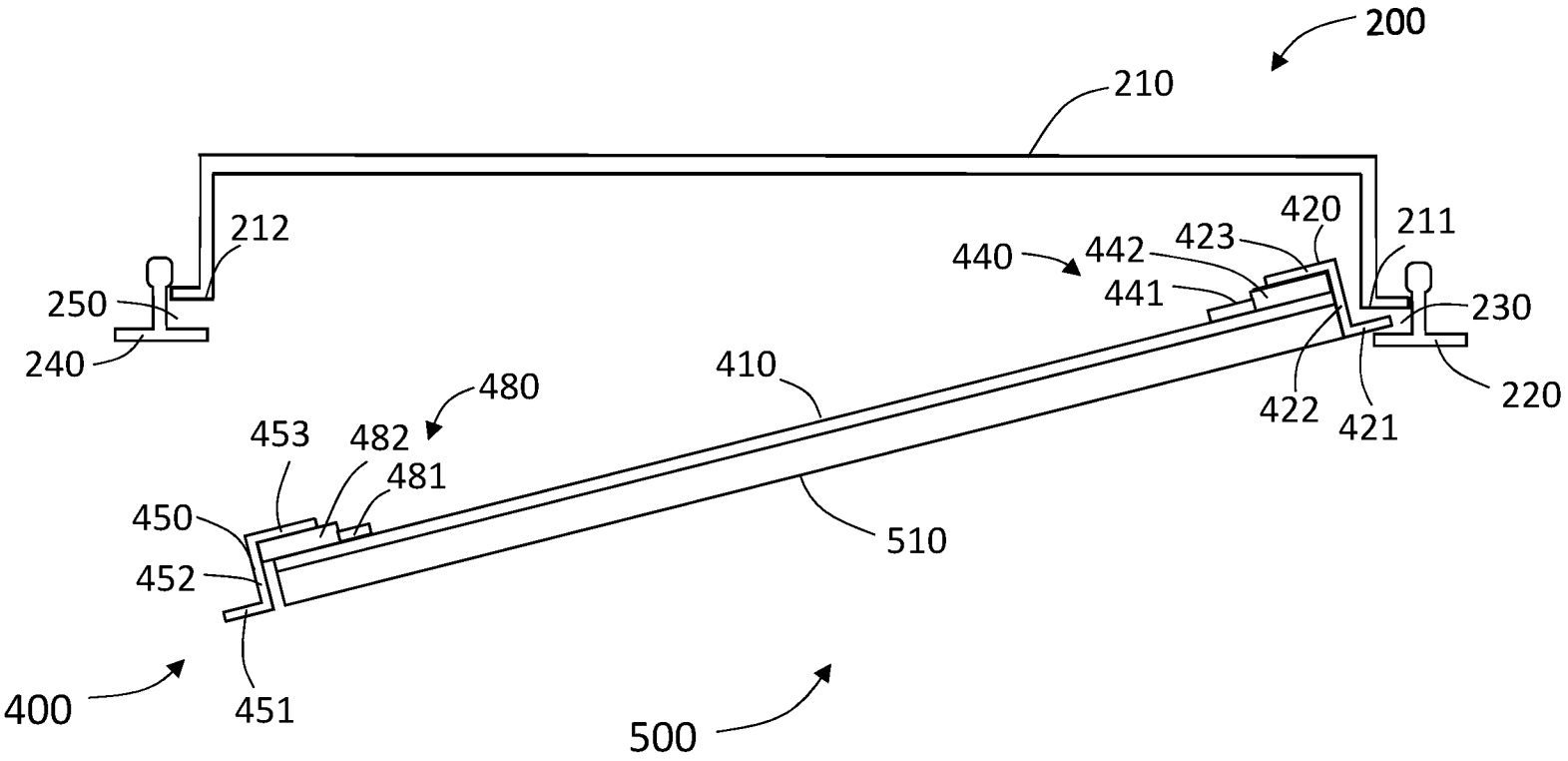
FIG. 4 is a sectional-view of the lighting system in FIG. 3 taken along line B-B.

FIGS. 3-4 show a lighting system 500 in accordance with an exemplary embodiment of the present disclosure, wherein FIG. 3 is a top view of the lighting system 500, and FIG. 4 is a sectional-view of the lighting system 500 in FIG. 3 taken along line B-B.

Referring to FIG. 3 and FIG. 4, the lighting system 500 comprises a lighting fixture 510 and an installation assembly 400. The installation assembly 400 is configured to contract in at least one direction to be at least partly embedded in a troffer 200, in such a manner that the lighting fixture 510 can be fixed in the troffer 200 via the installation assembly 400. The installation assembly 400 comprise a first loading bar 420, a second loading bar 450, a first elastic device 430, a first sliding unit 440, a second elastic device 460, a second sliding unit 480 and the bearing bar 140. The first loading bar 420 comprises a first projecting trim 421, a first side trim 422 and a first bottom trim 423, which are all strip-shaped and extend along a longitudinal direction of the first loading bar. The second loading bar 450 comprises a second projecting trim 451, a second side trim 452 and a second trim 453, which are all strip-shaped and extend along a longitudinal direction of the second loading bar.

The bearing bar 410 is fixed to a non-luminous surface of the lighting fixture 510. The first elastic device 430 and the first sliding unit 440 are provided between the bearing bar 410 and the first loading bar 420. A first end of the first elastic device 430 is fixed on the bearing bar 410, and a second end of the first elastic device 430 is fixed on the first loading bar 420, e.g.: the first side trim 422. The first sliding unit 440 comprises a slider 441 and a sliding rail 442, wherein the slider 441 is fixed on the bearing bar 410, and one end of the sliding rail 442 is fixed on the first loading bar 420, e.g.: the first side trim 422, in such a manner that a first side of the lighting fixture 510 with the bearing bar 410 is slidably connected with the first loading bar 420 via the first sliding unit 440.

The second elastic device 460 and the second sliding unit 480 are provided between the bearing bar 410 and the second loading bar 450. A first end of the second elastic device 460 is fixed on the bearing bar 410, and a second end of the second elastic device 460 is fixed on the second loading bar 450, e.g.: the second side trim 452. The second sliding unit 480 comprises a slider 481 and a sliding rail 482, wherein the slider 481 is fixed on the bearing bar 410, and one end of the sliding rail 482 is fixed on the second loading bar 450, e.g.: the second side trim 452, in such a manner that a second side of the lighting fixture 510 with the bearing bar 410 is slidably connected with the second loading bar 450 via the second sliding unit 480.

The first side trim 422 is connected between the first projecting trim 421 and the first bottom trim 423. The first projecting trim 421 extends from a first side of the first side trim 422 in a direction away from the lighting fixture 510, and the first bottom trim 423 extends from a second side of the first side trim 422 in a direction close to the lighting fixture 510. The first elastic device 430 and the first sliding unit 440 are provided between the first bottom trim 423 and the bearing bar 410. Similarly, structures of the second projecting trim 451, the second side trim 452, and the second bottom trim 453 and connections among them are respectively similar to those of the first projecting trim 421, the first side trim 422 and the first bottom trim 423. The second elastic device 460 and the second sliding unit 480 are provided between the second bottom trim 453 and the bearing bar 410.

In the embodiment shown in FIG. 4, a luminous surface of the lighting fixture 510 is flush with the first projecting trim 421 and the second projecting trim 451, such that when the lighting fixture 510 is installed in the troffer via the installation assembly 400, the lighting fixture 510 can be completely received in the troffer 200. In other embodiments, the luminous surface of the lighting fixture 510 may not be flush with the first and second projecting trim, for example, may protrudes from the first and second projecting trim.

Structures and functions of other elements of the installation assembly 400 and connection between them and the troffer are similar to those of the installation assembly 100 shown in FIG. 1 and FIG. 2, which will not be repeated here.

Embodiments of the present disclosure also relate to a method for retrofitting a troffer light by the lighting system described above. The troffer light needed to be retrofitted is recessed into a ceiling system comprising T-grids. The troffer light comprises a housing and a luminaire, wherein the housing is above the T-grids and comprises four side walls. There are gaps between the T-grids and lower edges of the four side walls. The lighting system comprises a lighting fixture, a safety tether, a first loading bar slidably connected to a first side of the lighting fixture, and a second loading bar connected to a second side of the lighting fixture opposite to the first side.

Figure 5:
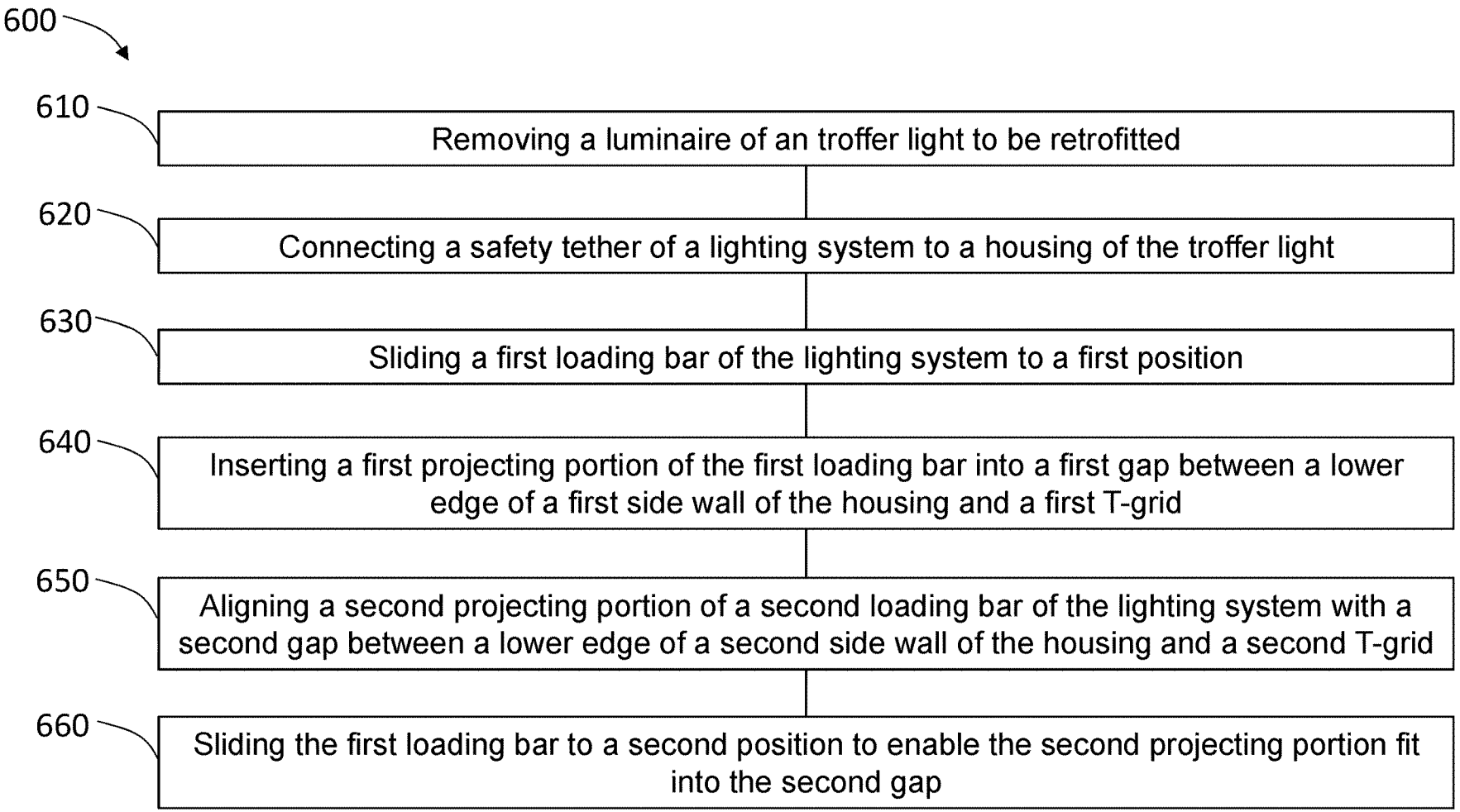
FIG. 5 is a flowchart illustrating a method for retrofitting a troffer light in accordance with an exemplary embodiment of the present disclosure.

Referring to FIG. 5, a method 600 comprises steps 610-660.

In step 610, the luminaire of the troffer light needed to be retrofit is removed.

In step 620, the safety tether of the lighting system is connected to the housing of the troffer light.

Step 630 relates to sliding the first loading bar to a first position in a direction substantially perpendicular to a longitudinal direction of the first loading bar.

Step 640 relates to inserting a first projecting portion of the first loading bar into a first gap between a lower edge of a first side wall of the housing and a first T-grid of the T-grids.

Step 650 relates to aligning a second projecting portion of the second loading bar with a second gap between a lower edge of a second side wall of the housing and a second T-grid of the T-grids.

Step 660 relates to sliding the first loading bar to a second position in the direction substantially perpendicular to the longitudinal direction of the first loading bar, to enable the second projecting portion fit into the second gap. In some embodiments, the first loading bar is slid from the first position to the second position by an elastic device.

In the above-mentioned retrofit method, before installing a new lighting system, the luminaire of the original troffer light is the only part needed to be removed. It is not necessary to remove the housing of the original troffer light. Therefore, the labor cost is greatly reduced. In addition, solutions in the present disclosure make full use of the gaps between the housing of the original troffer light and the T-grids to fix the new lighting system, which makes installation process of the new lighting system simple and fast.

As will be understood by those familiar with the art, the present disclosure may be embodied in other specific forms without depending from the spirit or essential characteristics thereof. Accordingly, the disclosures and descriptions herein are intended to be illustrative, but not limiting, of the scope of the disclosure which is set forth in the following claims.

The invention claimed is:

1. An installation assembly for a lighting fixture, wherein the installation assembly is connected with the lighting fixture and configured to contract in at least one direction to be at least partly embedded in a troffer, the installation assembly comprising:

a first loading bar, slidably connected to a first side of the lighting fixture and configured to slide in a direction substantially perpendicular to a longitudinal direction of the first loading bar, and the first loading bar comprising a first projecting portion; and a second loading bar, connected to a second side of the lighting fixture opposite to the first side and comprising a second projecting portion;

wherein the troffer has a first recessed portion and a second recessed portion respectively on two opposite inner side walls of the troffer, the first loading bar is configured to slide to a first position, to allow the first projecting portion and the second projecting portion to pass through an opening of the troffer into the troffer, and the first loading bar is configured to slide to a second position, to enable the first projecting portion to fit into the first recessed portion and the second projecting portion to fit into the second recessed portion.

2. The installation assembly according to claim 1, further comprising an elastic device provided between the first loading bar and the lighting fixture, and configured to move the first loading bar from the first position to the second position by an elastic force.

3. The installation assembly according to claim 1, further comprising a sliding unit provided between the first loading bar and the lighting fixture and configured to lead the first loading bar to slide along a path between the first position and the second position.

4. The installation assembly according to claim 1, wherein the troffer is defined by a housing of a troffer light and T-grids of a ceiling system, the first recessed portion is defined by a space between a lower edge of a first side wall of the housing and a first T-grid of the T-grids, and the second recessed portion is defined by a space between a lower edge of a second side wall of the housing and a second T-grid of the T-grids.

5. The installation assembly according to claim 1, wherein the second loading bar is slidably connected to the second side of the lighting fixture and configured to slide in a direction substantially perpendicular to a longitudinal direction of the second loading bar.

6. A lighting system, comprising:

a lighting fixture; and an installation assembly, connected with the lighting fixture and configured to contract in at least one direction to be at least partly embedded in a troffer, the installation assembly comprising:

a first loading bar, slidably connected to a first side of the lighting fixture and configured to slide in a direction substantially perpendicular to a longitudinal direction of the first loading bar, the first loading bar comprising a first projecting portion, and a second loading bar, connected to a second side of the lighting fixture opposite to the first side and comprising a second projecting portion, wherein the troffer has a first recessed portion and a second recessed portion respectively on two opposite inner side walls of the troffer, the first loading bar is configured to slide to a first position, to allow the first projecting portion and the second projecting portion to pass through an opening of the troffer into the troffer, and the first loading bar is configured to slide to a second position, to enable the first projecting portion to fit into the first recessed portion and the second projecting portion to fit into the second recessed portion.

7. The lighting system according to claim 6, further comprising an elastic device provided between the first loading bar and the lighting fixture, and configured to move the first loading bar from the first position to the second position by an elastic force.

8. The lighting system according to claim 6, further comprising a sliding unit provided between the first loading bar and the lighting fixture and configured to lead the first loading bar to slide along a path between the first position and the second position.

9. The lighting system according to claim 6, wherein the lighting fixture comprises a panel light, a troffer light or a combination thereof.

10. The lighting system according to claim 6, further comprising a safety tether having a first end connected to the lighting fixture or the installation assembly, and a second end configured to be connected to the troffer.

11. A method for retrofitting a troffer light by a lighting system, wherein the troffer light is recessed into a ceiling system comprising T-grids, the troffer light comprises a luminaire and a housing above the T-grids, and the lighting system comprises a lighting fixture, a first loading bar slidably connected to a first side of the lighting fixture and a second loading bar connected to a second side of the lighting fixture opposite to the first side, the method comprising:

removing the luminaire;

sliding the first loading bar to a first position in a direction substantially perpendicular to a longitudinal direction of the first loading bar;

inserting a first projecting portion of the first loading bar into a first gap between a lower edge of a first side wall of the housing and a first T-grid of the T-grids;

aligning a second projecting portion of the second loading bar with a second gap between a lower edge of a second side wall of the housing and a second T-grid of the T-grids; and sliding the first loading bar to a second position, to enable the second projecting portion fit into the second gap.

12. The method according to claim 11, wherein the sliding the first loading bar to the second position comprises sliding the first loading bar from the first position to the second position by an elastic device.

13. The method according to claim 11, further comprising connecting a safety tether of the lighting system to the housing after removing the luminaire.

* * * * *